US006725470B2

(12) United States Patent
Webb

(10) Patent No.: US 6,725,470 B2
(45) Date of Patent: Apr. 27, 2004

(54) SHOWER TRAY

(75) Inventor: Anthony Keith Webb, Onchan (GB)

(73) Assignee: DLP Limited, Braddan (GB)

( * ) Notice: Subject to any disclaimer, the term of this patent is extended or adjusted under 35 U.S.C. 154(b) by 0 days.

(21) Appl. No.: 10/158,053

(22) Filed: May 31, 2002

(65) Prior Publication Data

US 2003/0221252 A1 Dec. 4, 2003

(51) Int. Cl.[7] ..... A47K 3/40
(52) U.S. Cl. ..... 4/613
(58) Field of Search ..... 4/613, 599–602, 4/596, 612; 210/163, 153; 52/12

(56) References Cited

U.S. PATENT DOCUMENTS

| | | | | | |
|---|---|---|---|---|---|
| 3,551,918 A | | 1/1971 | Bergmark | | |
| 4,541,132 A | * | 9/1985 | Long | | 4/614 |
| 5,555,680 A | * | 9/1996 | Sweers | | 52/12 |
| 5,640,810 A | * | 6/1997 | Pietersen | | 52/12 |
| 5,718,008 A | * | 2/1998 | Pane | | 4/613 |
| 6,014,780 A | * | 1/2000 | Jurek et al. | | 4/613 |
| 6,240,578 B1 | * | 6/2001 | Planella | | 4/613 |

FOREIGN PATENT DOCUMENTS

| | | | | |
|---|---|---|---|---|
| EP | 0 492 147 A2 | | 7/1992 | |
| GB | 1 532 953 | | 11/1978 | |
| GB | 2108382 | * | 5/1983 | 4/613 |
| GB | 2276541 | * | 5/1994 | 4/613 |
| GB | 2 306 316 | | 5/1997 | |

* cited by examiner

*Primary Examiner*—Charles E. Phillips
(74) *Attorney, Agent, or Firm*—Young & Thompson

(57) ABSTRACT

A shower tray comprises a base unit having a raised central portion and a waste water outlet towards which run-off is directed, and a rim which is removably mounted on the base unit and which at least in part surrounds the central portion.

20 Claims, 2 Drawing Sheets

SHOWER TRAY

INTRODUCTION

This invention relates to a shower tray.

Shower trays which enable a handicapped person to take a shower while sitting in a wheelchair or bath chair are well-known. Such shower trays are either provided with an integral ramp enabling the person in the wheelchair to be wheeled from floor level up to the raised level of the showering surface, or are recessed into the floor, a socalled—level-entry—access, such that the showering surface on which the wheelchair or bath chair stands during showering is substantially level with the adjacent floor surface.

It has previously been proposed to provide a shower tray for a handicapped person which has a dished base unit and a removable cover plate supported above the base unit on which the wheelchair stands during showering. Run-off water passes through holes in the cover plate and is conducted towards a waste water outlet by the base unit.

A problem with this type of shower tray is that the cover plate has to be relatively large in order to comfortably accommodate a wheelchair or bath chair. A further problem resides in the fact that, in order to adequately bear the weight of a wheelchair or bath chair when positioned on the cover plate and, in the case of a wheelchair, when passing from the floor onto the cover plate, the cover plate must be strong and durable. These two drawbacks result in the cover plate becoming heavy and consequently difficult and awkward to remove for cleaning of the base unit to take place.

The present invention seeks to overcome these problems.

SUMMARY OF THE INVENTION

According to the present invention, there is provided a shower tray comprising a base unit having a raised central portion and waste water outlet means towards which run-off is directed, and a rim which is removably mounted on the base unit and which at least in part surrounds the central portion.

The invention will now be more particularly described, by way of example, with reference to the accompanying drawings.

DESCRIPTION OF THE PREFERRED EMBODIMENTS

Figure 1:
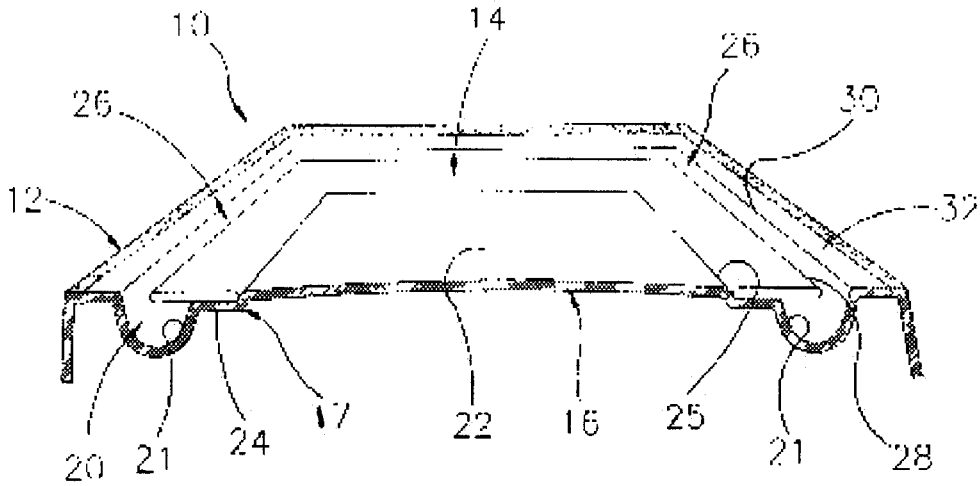
FIG. 1 is a perspective transverse section of one embodiment of a shower tray, in accordance with the present invention.
Figure 2:
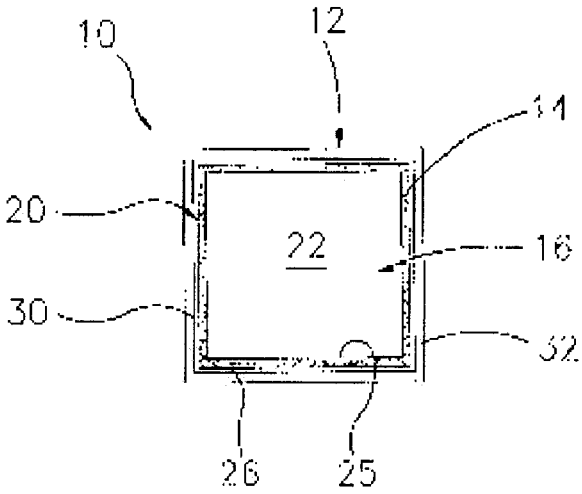
FIG. 2 is a plan view from above of the shower tray shown in FIG. 1.
Figure 3:
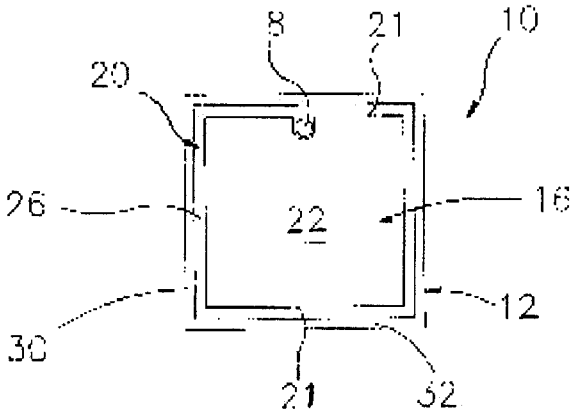
FIG. 3 is a plan view similar to FIG. 2, but showing the tray in a second condition.

Referring firstly to FIGS. 1 to 3 of the drawings, a shower tray 10 shown therein comprises a base unit 12, typically moulded from glass-fibre reinforced plastics (GRP) material or made from pressed material, and a rim 14 which is typically formed from stainless steel or aluminium.

The base unit 12 has a raised central portion 16 on which the rim 14 is removably mounted, a waste water outlet 18 and a waste water channel 20 which flows into the waste water outlet 18 to drain.

At least part of the upper surface 22 of the raised central portion 16 is non-planar and, in this embodiment, it is generally convex or shallow domed shaped. The upper surface 22 is able to stably support the weight of a fully loaded wheelchair and/or bath chair during showering.

The central portion 16 also has a stepped edge 17 which extends therearound and which forms a recess 24 in which the rim 14 can be located.

The recess 24 is of sufficient depth to enable the inner edge 25 of the rim 14, when positioned on the raised central portion 16, to be flush or substantially flush with the upper surface 22.

The waste water channel 20 typically surrounds the central raised portion 16 and runs in parallel with and adjacent to the rim 14 such that the rim 14 overhangs the longitudinal opening 26 of the channel 20. The extent of the overhang of the rim 14 should be sufficient to enable an approximately 8 millimetre gap to exist between the free outer edge 28 of the rim 14 and the outer edge 30 of the opening 26.

The rim 14 may be supported at its corners (and possibly midway along one or more sides) by protrusions (not shown) moulded into the outer wall of the channel 26. This will prevent the rim 14 twisting under edge loading by a wheelchair.

As best seen in FIG. 3, access to the waste water outlet 18 is typically from an opening in the inner wall 21 of the channel 20. The waste water outlet 18 is thus covered or entirely overhung by the rim 14.

The base unit 12 may also include a land 32 which extends in parallel with and adjacent to the outer edge 30 of the channel 20. The land 32 is typically in or substantially in the same plane as the rim 14 and may be wide enough to support a screen set (not shown) on one or more sides thereof. The screen set helps to prevent splashing of water from the shower tray 10 and may thus include doors if provided along all sides of the base unit 12.

The depth of the base unit 12 is sufficient to enable it to be installed within a floor such that the rim 14 is in or substantially in the plane of the floor to permit—level-entry—and—level-exit—. Alternatively, if the shower tray 10 is installed or free-standing on a floor, it may be provided with a ramp (not shown) to enable ramped access thereto from and to the floor.

In use, due to the convex or domed shape of the upper surface 22, the fall of the water will be from the raised central portion 16, over or under the rim 14, to the channel 20, and from there it will be conducted towards the waste water outlet 18 to drain.

Since the rim 14 is a frame type structure, it is relatively light weight and durable, and as such it can be easily removed, as shown in FIG. 3, to permit access for cleaning of the waste water outlet 18 and the channel 20. The rim 14 also enables unhindered or substantially unhindered access to the showering surface across the channel 20/waste water outlet 18 due to its significant overhang, and, acting in conjunction with the recess 24, reinforces the raised central portion 16 against detrimental transverse forces which may tend to splay or spread the raised central portion 16 due to the weight of a fully laden wheelchair or bath chair acting on its upper surface 22.

The rim 14 and/or the channel 20 may not necessarily extend completely around the central raised portion 16. For example, a bridge portion (not shown) completely extending over the channel 20 may be included on a side intended to permit access. In this case, the rim 14 may not extend along this side. Alternatively, a part of the channel 20, on a side intended to permit access, may be dispensed with altogether, and again the rim 14 may not extend along this side.

The recess 24 and/or rim 14 may include retaining means, such as resilient protrusions and/or notches, to locate the rim 14 more firmly in place during use.

Figure 4:
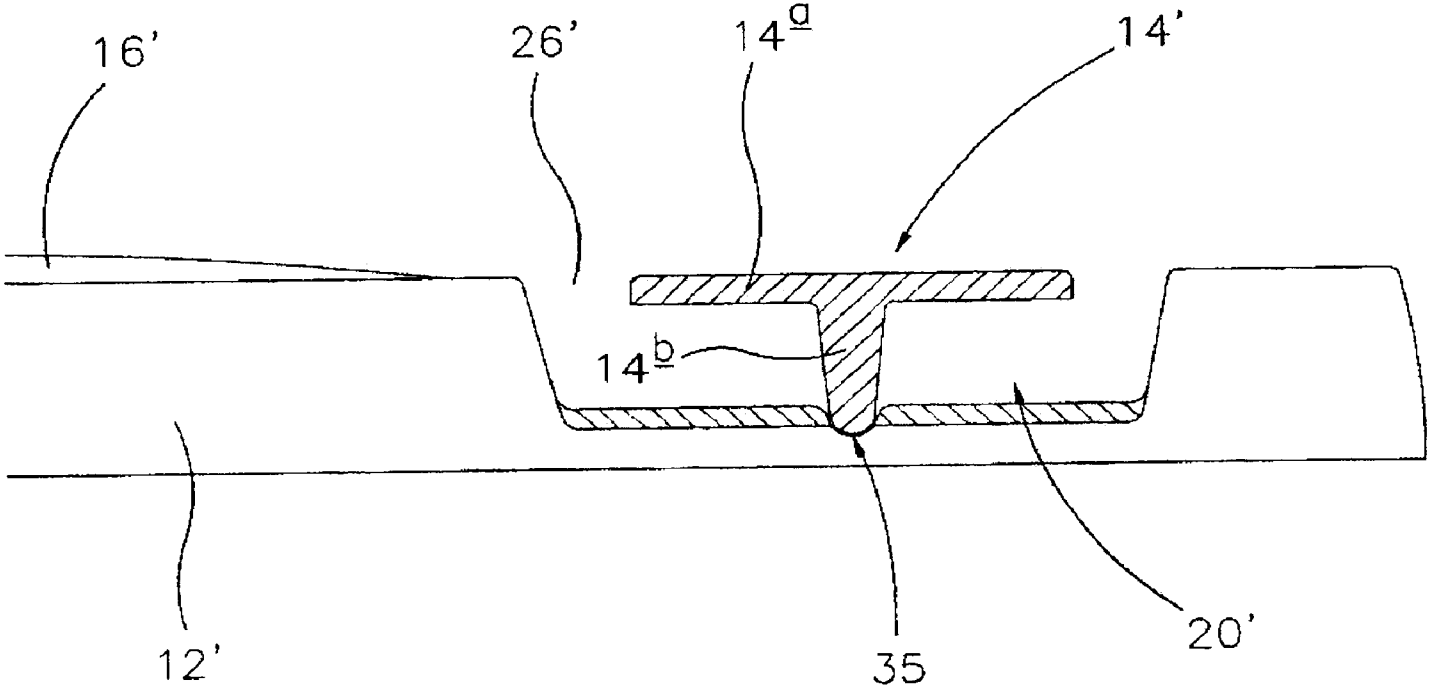
FIG. 4 is a fragmentary sectional view of another embodiment of the shower tray according to the invention on an enlarged scale.
Figure 2:
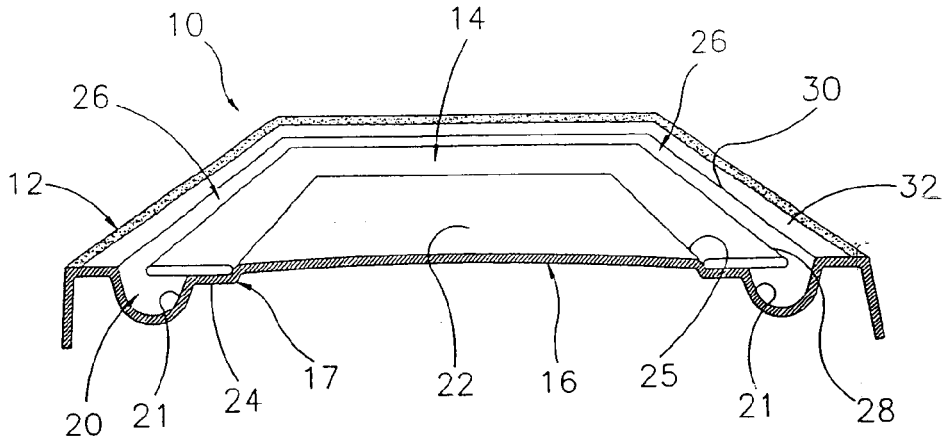
Figure 2:
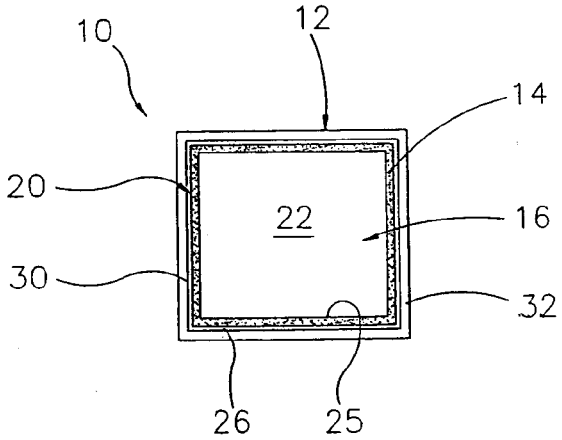
Figure 3:
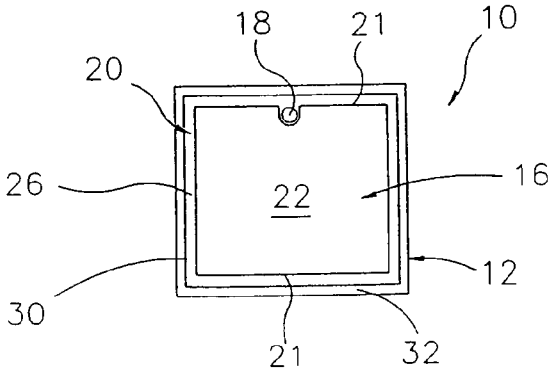
Figure 4:
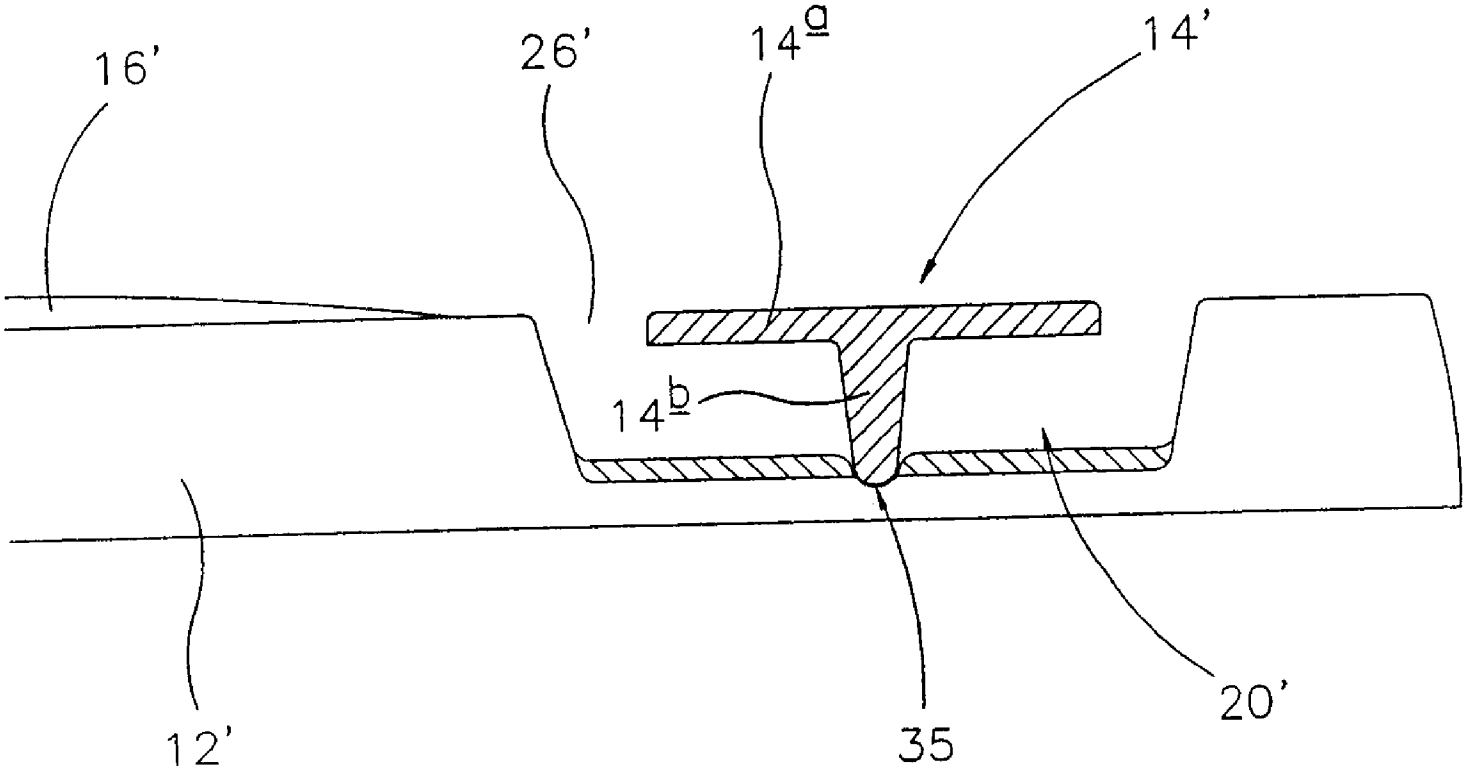

The rim 14 could be provided with perforations (not shown) and in this case could cover the entire opening 26 of the channel. Also, in this case, the rim 14 could be supported from the base of the channel 20 in addition to, or as an alternative to, being supported by the raised central portion 16 of the base unit 12. Indeed, FIG. 4 shows an embodiment in which the rim 14' is of T-shaped cross-section and is supported entirely by the base of the channel 20'.

The top portion 14*a* of the rim 14' has a width less than the width of the opening 26' of the channel 20' so as to provide gaps on opposite sides of the top portion 14*a* through which water can pass into the channel 20'. The bottom of the leg portion 14*b* of the rim 14' sits in a level groove 35 in the base of the channel 20' and the remainder of the channel base has a fall to waste.

The embodiments described above are given by way of example of and various modifications will be apparent to persons skilled in the art without departing from the scope of the invention. For example, although a shower tray having a generally quadrilateral shape has been depicted in the drawings, any suitable shape may be utilised; and the base unit and rim may be formed from any suitable material that provides adequate strength, durability and protection against corrosion.

What is claimed is:

1. A shower tray comprising a base unit having a raised central portion and waste water outlet means towards which run-off is directed, and a rim which is removably mounted on the base unit and which at least in part surrounds the central portion, wherein the rim is an open frame structure.

2. A shower tray as claimed in claim 1, wherein at least part of the upper surface of the raised central portion is generally convex or shallow domed shaped.

3. A shower tray as claimed in claim 1, wherein the waste water outlet means includes a channel which surrounds or substantially surrounds the raised central portion so that the run-off flows from the central portion into the channel.

4. A shower tray as claimed in claim 3, wherein the rim overhangs the longitudinal opening of the channel.

5. A shower tray as claimed in claim 4, wherein a gap of approximately 8 mm lies between the free outer edge of the rim and the outer edge of the channel.

6. A shower tray as claimed in claim 1, wherein the raised central portion is formed with a recess in which the rim can be located to sit flush or substantially flush with the upper surface of the central portion.

7. A shower tray as claimed in claim 3, wherein the rim is supported in the channel.

8. A shower tray as claimed in claim 7, wherein the rim is of T-shaped cross-section.

9. A shower tray as claimed in claim 1, wherein the rim is formed from stainless steel.

10. A shower tray as claimed in claim 1, wherein the shower tray is installable within flooring such that the rim lies in or substantially in the plane of the floor.

11. A shower tray as claimed in claim 1, wherein the shower tray is installable on flooring and is provided with ramp access thereto.

12. A shower tray as claimed in claim 1, wherein the base unit further comprises a land.

13. A shower tray as claimed in claim 1, wherein the base unit is formed from glass-fibre reinforced plastics material.

14. A shower tray comprising a base unit having a raised central portion and waste water outlet means towards which run-off is directed, and a rim which is removably mounted on the base unit and which at least in part surrounds the central portion, wherein the raised central portion comprises a recess in which the rim can be located to sit flush or substantially flush with the upper, surface of the raised central portion.

15. A shower tray as claimed in claim 14, wherein at least part of the upper surface of the raised central portion is generally convex or shallow domed shaped.

16. A shower tray as claimed in claim 14, wherein the waste water outlet means includes a channel which surrounds or substantially surrounds the raised central portion so that the run-off flows from the central portion into the channel.

17. A shower tray as claimed in claim 16, wherein the rim overhangs the longitudinal opening of the channel.

18. A shower tray as claimed in claim 16, wherein the rim is supported in the channel.

19. A shower tray as claimed in claim 18, wherein the rim is of T-shaped cross-section.

20. A shower tray as claimed in claim 14, wherein the shower tray is installable within flooring such that the rim lies in or substantially in the plane of the floor.

* * * * *

UNITED STATES PATENT AND TRADEMARK OFFICE

CERTIFICATE OF CORRECTION

PATENT NO. : 6,725,470 B2
DATED : April 27, 2004
INVENTOR(S) : Webb

It is certified that error appears in the above-identified patent and that said Letters Patent is hereby corrected as shown below:

Delete Title page illustrating figure, and substitute therefor new Title page illustrating figure. (attached)

Delete drawing sheets 1-4, and substitute therefor drawing sheets 1-4, as shown on the attached sheet.

Signed and Sealed this

Twenty-fourth Day of August, 2004

JON W. DUDAS
*Director of the United States Patent and Trademark Office*

(12) United States Patent
Webb

(10) Patent No.: US 6,725,470 B2
(45) Date of Patent: Apr. 27, 2004

(54) SHOWER TRAY

(75) Inventor: Anthony Keith Webb, Onchan (GB)

(73) Assignee: DLP Limited, Braddan (GB)

( * ) Notice: Subject to any disclaimer, the term of this patent is extended or adjusted under 35 U.S.C. 154(b) by 0 days.

(21) Appl. No.: 10/158,053

(22) Filed: May 31, 2002

(65) Prior Publication Data

US 2003/0221252 A1 Dec. 4, 2003

(51) Int. Cl.[7] ..... A47K 3/40
(52) U.S. Cl. ..... 4/613
(58) Field of Search ..... 4/613, 599–602, 4/596, 612; 210/163, 153; 52/12

(56) References Cited

U.S. PATENT DOCUMENTS

| | | | | | |
|---|---|---|---|---|---|
| 3,551,918 A | | 1/1971 | Bergmark | | |
| 4,541,132 A | * | 9/1985 | Long | | 4/614 |
| 5,555,680 A | * | 9/1996 | Sweers | | 52/12 |
| 5,640,810 A | * | 6/1997 | Pietersen | | 52/12 |
| 5,718,008 A | * | 2/1998 | Pane | | 4/613 |
| 6,014,780 A | * | 1/2000 | Jurek et al. | | 4/613 |
| 6,240,578 B1 | * | 6/2001 | Planella | | 4/613 |

FOREIGN PATENT DOCUMENTS

| | | | | |
|---|---|---|---|---|
| EP | 0 492 147 A2 | | 7/1992 | |
| GB | 1 532 953 | | 11/1978 | |
| GB | 2108382 | * | 5/1983 | 4/613 |
| GB | 2276541 | * | 5/1994 | 4/613 |
| GB | 2 306 316 | | 5/1997 | |

* cited by examiner

*Primary Examiner*—Charles E. Phillips
(74) *Attorney, Agent, or Firm*—Young & Thompson

(57) ABSTRACT

A shower tray comprises a base unit having a raised central portion and a waste water outlet towards which run-off is directed, and a rim which is removably mounted on the base unit and which at least in part surrounds the central portion.

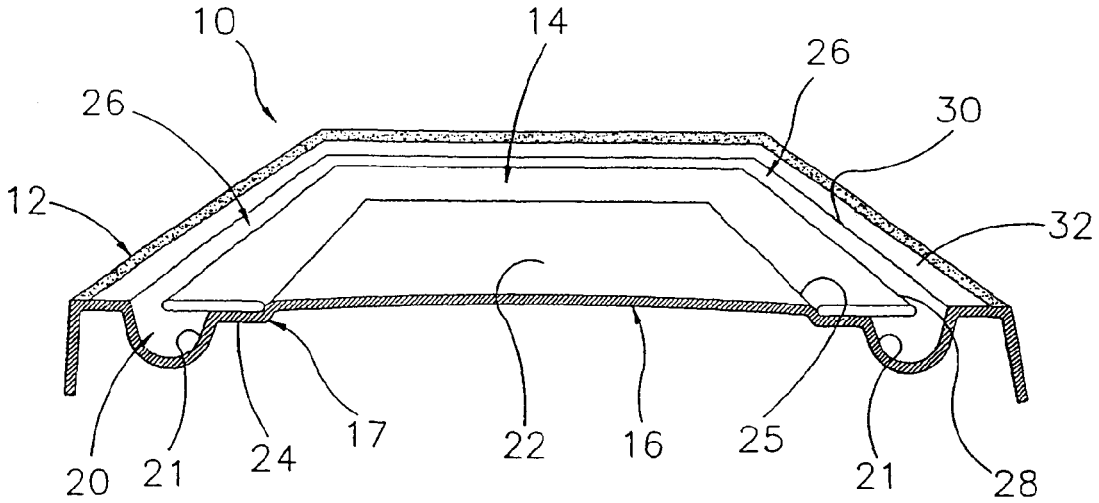

20 Claims, 2 Drawing Sheets